US011011114B2

(12) United States Patent
Meng et al.

(10) Patent No.: US 11,011,114 B2
(45) Date of Patent: May 18, 2021

(54) COMPENSATION METHOD, DEVICE, CIRCUIT FOR DISPLAY PANEL, DISPLAY PANEL AND DISPLAY DEVICE

(71) Applicant: BOE TECHNOLOGY GROUP CO., LTD., Beijing (CN)

(72) Inventors: Song Meng, Beijing (CN); Zhongyuan Wu, Beijing (CN); Danna Song, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 148 days.

(21) Appl. No.: 16/335,009

(22) PCT Filed: Aug. 31, 2018

(86) PCT No.: PCT/CN2018/103386
§ 371 (c)(1),
(2) Date: Mar. 20, 2019

(87) PCT Pub. No.: WO2019/109683
PCT Pub. Date: Jun. 13, 2019

(65) Prior Publication Data

US 2020/0388219 A1 Dec. 10, 2020

(30) Foreign Application Priority Data

Dec. 7, 2017 (CN) ..... 201711287008.0

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2300/0426* (2013.01);
(Continued)

(58) Field of Classification Search
CPC ..... G09G 3/3208–3233; G09G 3/3258; G09G 2320/043; G09G 2320/045; G09G 3/3233;
(Continued)

(56) References Cited

U.S. PATENT DOCUMENTS 9,704,432 B2 * 7/2017 Zhang ..... G09G 3/3225
2006/0145982 A1 7/2006 Tseng
(Continued)

FOREIGN PATENT DOCUMENTS

CN 102347015 A 2/2012
CN 103327275 A 9/2013
(Continued)

OTHER PUBLICATIONS

First Office Action for CN Appl. No. 201711287008.0, dated Apr. 30, 2019.
(Continued)

*Primary Examiner* — Sanjiv D. Patel
(74) *Attorney, Agent, or Firm* — The Webb Law Firm

(57) ABSTRACT

The present disclosure provides a compensation method, device, circuit for a display panel, a display panel and a display device. The display panel includes a plurality of pixel circuits, each of which comprises a driving transistor. The compensation method includes: obtaining a first compensation grayscale value $GL_1$ and a second compensation grayscale value $GL_2$ of a pixel circuit to be compensated; obtaining a first compensation luminance $L_1$, a first gate-source voltage $V_{gs1}$ of the driving transistor, a second compensation luminance $L_2$, and a second gate-source voltage $V_{gs2}$ of the driving transistor, wherein $L_1$ and $V_{gs1}$ correspond to $GL_1$, and $L_2$ and $V_{gs2}$ correspond to $GL_2$; obtaining a theoretical luminance L corresponding to an input grayscale value GL; calculating the compensation
(Continued)

gate-source voltage $V'_{gs}$ by using L, $L_1$, $V_{gs1}$, $L_2$, and $V_{gs2}$; and obtaining an output compensation grayscale value GL' according to $V'_{gs}$.

19 Claims, 7 Drawing Sheets

(52) U.S. Cl.
CPC . *G09G 2310/08* (2013.01); *G09G 2320/0233* (2013.01); *G09G 2320/043* (2013.01)

(58) Field of Classification Search
CPC ..... G09G 2320/0233; G09G 2360/16; G09G 2320/0285; G09G 2320/0693; G09G 2320/0673; G09G 2320/0276
See application file for complete search history.

(56) References Cited

U.S. PATENT DOCUMENTS

2014/0168188 A1 6/2014 Jun et al.
2015/0243219 A1* 8/2015 In ..... G09G 3/2081 345/212
2016/0189623 A1* 6/2016 Miwa ..... G09G 3/3233 345/212
2017/0270855 A1* 9/2017 Maeda ..... G09G 3/3233
2018/0082627 A1* 3/2018 Deng ..... G09G 3/3275
2019/0130853 A1* 5/2019 Zhu ..... G09G 3/36
2019/0206326 A1* 7/2019 Wang ..... G09G 3/3258

FOREIGN PATENT DOCUMENTS

CN 103854556 A 6/2014
CN 104021759 A 9/2014
CN 104318900 A 1/2015
CN 106652966 A 5/2017
CN 106847187 A 6/2017
CN 107093403 A 8/2017
CN 107909965 A 4/2018
KR 20090040740 A 4/2009

OTHER PUBLICATIONS

International Search Report and Written Opinion for International Appl. No. PCT/CN2018/103386, dated Oct. 16, 2018.

* cited by examiner

COMPENSATION METHOD, DEVICE, CIRCUIT FOR DISPLAY PANEL, DISPLAY PANEL AND DISPLAY DEVICE

CROSS-REFERENCE TO RELATED APPLICATIONS

The present application is a U.S. National Stage Application under 35 U.S.C. § 371 of International Patent Application No. PCT/CN2018/103386, filed on Aug. 31, 2018, which claims priority to Chinese Patent Application No. 201711287008.0, filed on Dec. 7, 2017, the disclosure of both of which are incorporated by reference herein in entirety.

TECHNICAL FIELD

The present disclosure relates to a compensation method, device, circuit for a display panel, a display panel and a display device.

BACKGROUND

In the circuit of the current AMOLED (Active Matrix Organic Light Emitting Diode) display panel, an electrical compensation can be realized by a sensing voltage line. That is, a specific voltage is input to a data terminal, and a sensing current is generated on a driving TFT (Thin Film Transistor). The current is accumulated on the sensing voltage line to form a sensing voltage, and the data voltage is corrected according to the magnitude of the sensing voltage, thereby realizing compensation of the TFT.

Moreover, the electrical compensation method applied to display panels in the related art further comprises a method of directly acquiring a threshold voltage of a driving transistor. The method comprises: applying a fixed voltage to a gate terminal of the driving transistor to generate a driving current to charge the sensing voltage line. A gate-source voltage of the driving transistor decreases as the sensing voltage line voltage increases. The voltage of the sensing voltage line stops increasing when the gate-source voltage of the driving transistor decreases to be equal to the threshold voltage of the driving transistor, and a difference between the voltage of the data line and the voltage of the sensing voltage line is the threshold voltage.

SUMMARY

According to an aspect of embodiments of the present disclosure, there is provided a compensation method for a display panel, the display panel comprising a plurality of pixel circuits, each of the pixel circuits comprising a driving transistor, the compensation method comprising: obtaining a first compensation grayscale value $GL_1$ and a second compensation grayscale value $GL_2$ of a pixel circuit to be compensated; obtaining a first compensation luminance $L_1$, a first gate-source voltage $V_{gs1}$ of the driving transistor, a second compensation luminance $L_2$, and a second gate-source voltage $V_{gs2}$ of the driving transistor, which are of the pixel circuit to be compensated, wherein the first compensation luminance $L_1$ and the first gate-source voltage $V_{gs1}$ correspond to the first compensation grayscale value $GL_1$, and the second compensation luminance $L_2$ and the second gate-source voltage $V_{gs2}$ correspond to the second compensation grayscale value $GL_2$; obtaining a theoretical luminance L corresponding to an input grayscale value GL; calculating a compensation gate-source voltage $V'_g$s according to the theoretical luminance L, the first compensation luminance $L_1$, the first gate-source voltage $V_{gs1}$, the second compensation luminance $L_2$, and the second gate-source voltage $V_{gs2}$; and obtaining an output compensation grayscale value GL' according to the compensation gate-source voltage $V'_{gs}$.

In some embodiments, $$V'_{gs} = \sqrt[a]{\frac{L}{L_1}} * \frac{\sqrt[a]{\frac{L_1}{L_2}}(V_{gs1} - V_{gs2})}{\sqrt[a]{\frac{L_1}{L_2}} - 1} + \frac{V_{gs2} * \sqrt[a]{\frac{L_1}{L_2}} - V_{gs1}}{\sqrt[a]{\frac{L_1}{L_2}} - 1},$$

where "a" is a known exponential parameter.

In some embodiments, the first compensation luminance $L_1$ is a maximum luminance $L_{max}$, and the second compensation luminance $L_2$ is $$\frac{L_{max}}{b^a},$$

where b is a setting parameter, $$V'_{gs} = \sqrt[a]{\frac{L}{L_{max}}} * \frac{b(V_{gs1} - V_{gs2})}{b-1} + \frac{b * V_{gs2} - V_{gs1}}{b-1}$$

In some embodiments, the maximum luminance $L_{max}$ is a normalized luminance value, $$L_{max} = 1,\ b = 2,\ V'_{gs} = \sqrt[a]{L} * 2(V_{gs1} - V_{gs2}) + 2V_{gs2} - V_{gs1}.$$

In some embodiments, the exponential parameter "a" is obtained by the following steps: lighting up a region of the display panel such that the luminance of the region reaches the maximum luminance $L_{max}$, and measuring a first gate-source voltage $V'_{gs1}$ of a driving transistor of a pixel circuit in the region corresponding to the maximum luminance; measuring a threshold voltage $V_t$ of the driving transistor in the region; calculating a second gate-source voltage $V_{gs2}$ of the driving transistor in the region according to the first gate-source voltage $V'_{gs1}$ and the threshold voltage $V_t$ of the region, wherein $$V'_{gs2} = \frac{b-1}{b}V_t + \frac{1}{b}V'_{gs1};$$

lighting up the region using the second gate-source voltage $V_{gs2}$, and measuring a second compensation luminance $L_2$; and calculating the exponential parameter "a" according to $$\frac{L_{max}}{L_2} = b^a.$$

In some embodiments, the pixel circuit further comprises a first switching transistor, a second switching transistor, a light emitting diode, and a capacitor; a gate electrode of the first switching transistor is electrically connected to a first gate line, a first electrode of the first switching transistor is electrically connected to a data line, a second electrode of the first switching transistor is electrically connected to a gate electrode of the driving transistor; the gate electrode of the driving transistor is electrically connected to a first terminal of the capacitor, a drain electrode of the driving transistor is electrically connected to a power supply voltage terminal, a source electrode of the driving transistor is electrically connected to an anode terminal of the light emitting diode; a second terminal of the capacitor is electrically connected to the anode terminal of the light emitting diode, and a cathode terminal of the light emitting diode is electrically connected to a ground terminal; a gate electrode of the second switching transistor is electrically connected to a second gate line, and a first electrode of the second switching transistor is electrically connected to the source electrode of the driving transistor, and a second electrode of the second switching transistor is electrically connected to a sensing voltage line.

In some embodiments, the step of obtaining the first gate-source voltage $V_{gs1}$ of the driving transistor of the pixel circuit to be compensated comprises the following steps: inputting a first gate-source voltage of the region into a pixel circuit in the region through a data line, and continuously charging a sensing voltage line electrically connected to the pixel circuit in the region for a first predetermined time to obtain a first target voltage $V_{target1}$; in a field blanking stage, inputting a first input voltage to a data line electrically connected to the pixel circuit to be compensated, continuously charging a sensing voltage line electrically connected to the pixel circuit to be compensated for the first predetermined time, and measuring a charge voltage of the sensing voltage line; adjusting the first input voltage based on a determination that the measured charge voltage is not equal to the first target voltage $V_{target1}$, continuously recharging the sensing voltage line electrically connected to the pixel circuit to be compensated for the first predetermined time and measuring the charge voltage in a next field blanking stage; repeating the adjusting, charging and measuring until the measured charge voltage is equal to the first target voltage $V_{target1}$; and obtaining the first gate-source voltage of the pixel circuit to be compensated according to a corresponding first input voltage input to the data line based on a determination that the measured charge voltage is equal to the first target voltage $V_{target1}$.

In some embodiments, the step of obtaining the second gate-source voltage $V_{gs2}$ of the driving transistor of the pixel circuit to be compensated comprises the following steps: inputting a second gate-source voltage of the region into a pixel circuit in the region through a data line, and continuously charging a sensing voltage line electrically connected to the pixel circuit in the region for a second predetermined time to obtain a second target voltage $V_{target2}$; in a field blanking stage, inputting a second input voltage to the data line electrically connected to the pixel circuit to be compensated, continuously charging a sensing voltage line electrically connected to the pixel circuit to be compensated for the second predetermined time, and measuring a charge voltage of the sensing voltage line; adjusting the second input voltage based on a determination that the measured charge voltage is not equal to the second target voltage $V_{target2}$, continuously recharging the sensing voltage line electrically connected to the pixel circuit to be compensated for the second predetermined time and measuring the charge voltage in a next field blanking stage; repeating the adjusting, charging and measuring until the measured charge voltage is equal to the second target voltage $V_{target2}$; and obtaining the second gate-source voltage of the pixel circuit to be compensated according to a corresponding second input voltage input to the data line based on a determination that the measured charge voltage is equal to the second target voltage $V_{target2}$.

In some embodiments, the step of continuously charging the sensing voltage line for the first predetermined time comprises the following steps: turning on the first switching transistor and the second switching transistor, and inputting the first input voltage to the data line, with the first input voltage being stored at the first terminal of the capacitor and the driving transistor being turned on by the first input voltage stored at the first terminal; and turning off the first switching transistor and turning on the second switching transistor, so that the sensing voltage line is charged for the first predetermined time by the power supply voltage terminal through the driving transistor and the second switching transistor; wherein, based on a determination that the measured charge voltage is equal to the first target voltage $V_{target1}$, the corresponding first input voltage input to the data line is the first gate-source voltage of the pixel circuit to be compensated.

In some embodiments, the step of continuously charging the sensing voltage line for the first predetermined time comprises the following steps: turning on the first switching transistor and the second switching transistor, and inputting the first input voltage to the data line to turn on the driving transistor, so that the sensing voltage line is charged for the first predetermined time by the power supply voltage terminal through the driving transistor and the second switching transistor; wherein, based on a determination that the measured charge voltage is equal to the first target voltage $V_{target1}$, a difference between the corresponding first input voltage input to the data line and the measured charge voltage is the first gate-source voltage of the pixel circuit to be compensated.

In some embodiments, the step of continuously charging the sensing voltage line for the second predetermined time comprises the following steps: turning on the first switching transistor and the second switching transistor, and inputting the second input voltage to the data line, with the second input voltage being stored at the first terminal of the capacitor and the driving transistor being turned on by the second input voltage stored at the first terminal; and turning off the first switching transistor and turning on the second switching transistor, so that the sensing voltage line is charged for the second predetermined time by the power supply voltage terminal through the driving transistor and the second switching transistor; wherein, based on a determination that the measured charge voltage is equal to the second target voltage $V_{target2}$, the corresponding second input voltage input to the data line is the second gate-source voltage of the pixel circuit to be compensated.

In some embodiments, the step of continuously charging the sensing voltage line for the second predetermined time comprises the following steps: turning on the first switching transistor and the second switching transistor, and inputting the second input voltage to the data line to turn on the driving transistor, so that the sensing voltage line is charged for the second predetermined time by the power supply voltage terminal through the driving transistor and the second switching transistor; wherein, based on a determination that the measured charge voltage is equal to the second target voltage $V_{target2}$, a difference between the corresponding second input voltage input to the data line and the measured charge voltage is the second gate-source voltage of the pixel circuit to be compensated.

In some embodiments, the step of obtaining the theoretical luminance L corresponding to the input grayscale value GL comprises: obtaining a corresponding theoretical luminance L according to the input grayscale value GL and a curve of the luminance versus the grayscale value.

In some embodiments, the step of obtaining the output compensation grayscale value GL' according to the compensation gate-source voltage $V'_{gs}$ comprises the following steps: obtaining a compensation gate voltage $V'_g$ according to the compensation gate-source voltage $V'_{gs}$; and obtaining the output compensation grayscale value GL' according to the compensation gate voltage $V'_g$ and a correspondence relationship between a grayscale value and a gate voltage.

According to another aspect of embodiments of the present disclosure, there is provided a compensation device for a display panel, comprising: a memory; and a processor coupled to the memory, the processor configured to execute the method as described above based on instructions stored in the memory.

According to another aspect of embodiments of the present disclosure, there is provided a circuit for a display panel, comprising: a compensation device configured to receive an input grayscale value GL, and obtain an output compensation grayscale value GL' according to the compensation method as described above; a conversion circuit configured to convert the output compensation grayscale value GL' to a compensation data voltage $V_{data}$ according to a correspondence relationship between the grayscale value and the voltage after receiving the output compensation grayscale value GL' from the compensation device; and a pixel circuit configured to emit light according to the compensation data voltage $V_{data}$.

According to another aspect of embodiments of the present disclosure, there is provided a display panel, comprising: the circuit for the display panel as described above.

According to another aspect of embodiments of the present disclosure, there is provided a display device comprising: a display panel as described above.

According to another aspect of embodiments of the present disclosure, there is provided a computer-readable storage medium on which computer program instructions are stored, wherein the computer program instructions when executed by a processor implement the steps of the method as described above.

Other features and advantages of the present disclosure will become apparent from the following detailed description of exemplary embodiments of the present disclosure with reference to the accompanying drawings.

BRIEF DESCRIPTION OF THE DRAWINGS

The accompanying drawings, which constitute a part of this specification, illustrate embodiments of the present disclosure and, together with the description, serve to explain the principles of the present disclosure.

The present disclosure will be more clearly understood from the following detailed description with reference to the accompanying drawings, in which.

Figure 1:
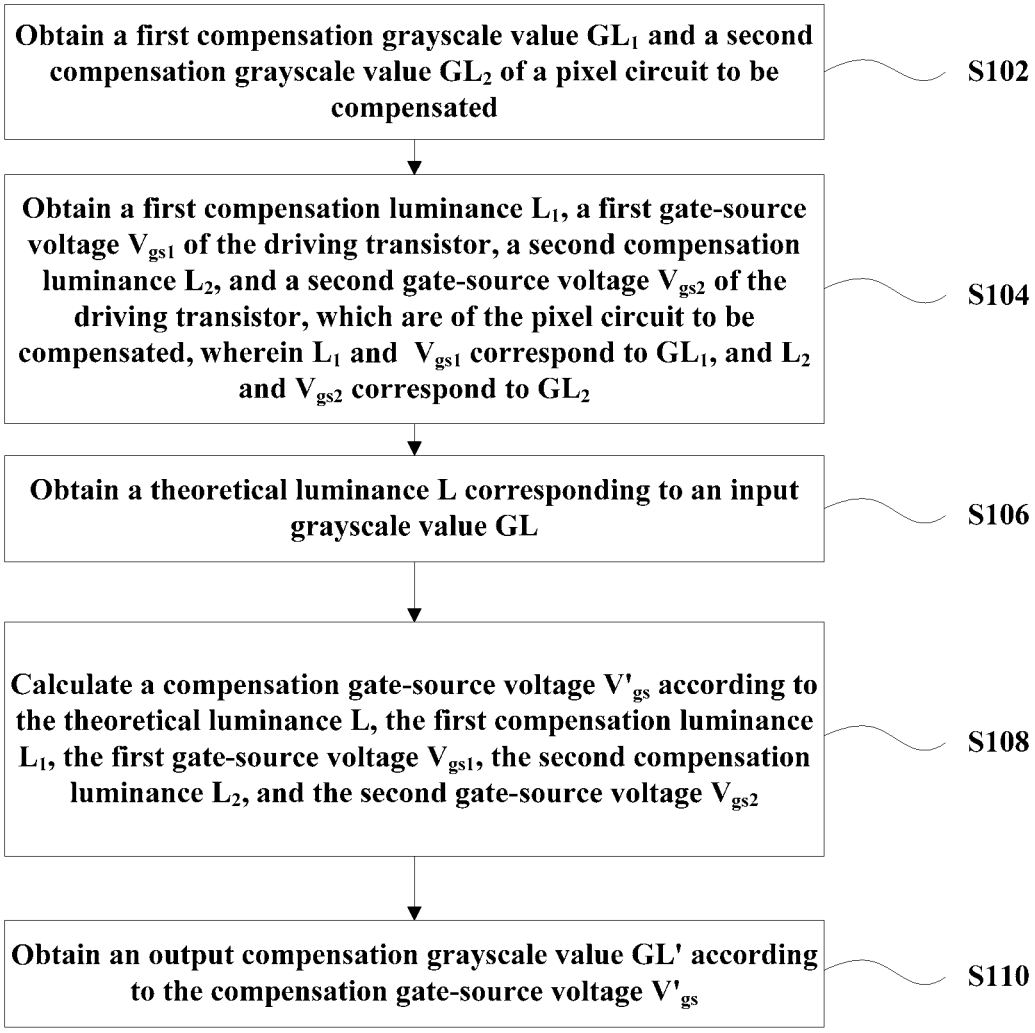
FIG. 1 is a flowchart illustrating a compensation method for a display panel according to an embodiment of the present disclosure.

It should be understood that the dimensions of the various parts shown in the drawings are not drawn to the actual scale. In addition, the same or similar reference signs are used to denote the same or similar components.

DETAILED DESCRIPTION

Various exemplary embodiments of the present disclosure will now be described in detail with reference to the accompanying drawings. The following description of the exemplary embodiments is in fact merely illustrative and is in no way intended as a limitation to the present disclosure, its application or use. The present disclosure may be implemented in many different forms, not limited to the embodiments described herein. These embodiments are provided so that this disclosure will be thorough and complete, and will fully convey the scope of the disclosure to those skilled in the art. Notice that, unless specifically stated otherwise, relative arrangement of components and steps, material composition, numerical expressions, and numerical values set forth in these embodiments are to be construed as merely illustrative, and not as a limitation.

The use of the terms "first", "second" or the like in the present disclosure does not denote any order, quantity or importance, but are merely used to distinguish between different components. A word such as "includes" or "comprises" means that the element before the word covers the elements listed after the word, without excluding the possibility of also covering other elements. The terms "up", "down", "left", "right" or the like are used only to represent a relative positional relationship, and the relative positional relationship may be changed if the absolute position of the described object changes.

In the present disclosure, when it is described that a particular device is disposed between a first device and a second device, there may be an intermediate device between the particular device and the first device or the second device, or there may be no intermediate device. When it is described that a particular device is connected to other devices, the particular device may be directly connected to said other devices without an intermediate device, and alternatively, may not be directly connected to said other devices but with an intermediate device.

Unless otherwise defined, all the terms (including technical and scientific terms) used in the present disclosure have the same meanings as commonly understood by those skilled in the art of the present disclosure. It is also to be understood that those terms defined in for example general dictionaries should be construed as having meanings consistent with those in the context of the related art, rather than being construed in an idealized or extremely formalized sense unless thus explicitly defined here.

Techniques, methods, and apparatus known to those of ordinary skill in the relevant art may not be discussed in detail, but where appropriate, these techniques, methods, and apparatuses should be considered as part of the specification.

The inventors of the present disclosure have recognized that the charging process in the above method of the related art takes a long time, and thus cannot be completed in real time display.

In view of this, embodiments of the present disclosure provide a compensation method for a display panel to achieve real-time compensation for pixel luminance.

FIG. 1 is a flowchart illustrating a compensation method for a display panel according to an embodiment of the present disclosure. The display panel comprises a plurality of pixel circuits, each of which comprises a driving transistor.

In step S102, a first compensation grayscale value $GL_1$ and a second compensation grayscale value $GL_2$ of a pixel circuit to be compensated are obtained. Here, the first compensation grayscale value refers to a first grayscale value after being compensated, which can cause a luminance corresponding to an first grayscale value before being compensated to reach a corresponding first ideal luminance (also referred to as a first compensation luminance). The second compensation grayscale value refers to a second grayscale value after being compensated, which can cause a luminance corresponding to an second grayscale value before being compensated to reach a corresponding second ideal luminance (also referred to as a second compensation luminance).

For example, two compensation grayscale values $GL_1$ and $GL_2$ of a pixel circuit to be compensated in the display panel may be obtained by actual adjustment. These two compensation grayscale values may enable the pixel to emit corresponding ideal luminances in the case of the above two grayscale values before being compensated, respectively.

For another example, two compensation grayscale values of one region in the display panel may be obtained by actually adjustment, and the two compensation grayscale values may enable a pixel in the region to emit corresponding ideal luminances in the case of the above two grayscale values before being compensated, respectively. Then, based on these two compensation grayscale values, two compensation grayscale values $GL_1$ and $GL_2$ of other pixel circuits to be compensated of the display panel can be obtained by the methods shown in FIGS. 6 and 7, respectively. The methods shown in FIGS. 6 and 7 will be described in detail later.

In step S104, a first compensation luminance $L_1$, a first gate-source voltage $V_{gs1}$ of the driving transistor, a second compensation luminance $L_2$, and a second gate-source voltage $V_{gs2}$ of the driving transistor, which are of the pixel circuit to be compensated, are obtained. That is, the first compensation luminance $L_1$ of the pixel circuit to be compensated is obtained, the first gate-source voltage $V_{gs1}$ of the driving transistor of the pixel circuit to be compensated is obtained, the second compensation luminance $L_2$ of the pixel circuit to be compensated is obtained, and the second gate-source voltage $V_{gs2}$ of the driving transistor of the pixel circuit to be compensated is obtained. The first compensation luminance $L_1$ and the first gate-source voltage $V_{gs1}$ correspond to the first compensation grayscale value $GL_1$, and the second compensation luminance $L_2$ and the second gate-source voltage $V_{gs2}$ correspond to the second compensation grayscale value $GL_2$.

In some embodiments, the first compensation luminance $L_1$ corresponding to the first compensation grayscale value $GL_1$ and the second compensation luminance $L_2$ corresponding to the second compensation grayscale value $GL_2$ may be obtained according to a curve of a luminance versus a grayscale value (which may be referred to as a Gamma curve). For example, the curve of the luminance versus the grayscale value can be referred to FIG. 4.

Figure 4:
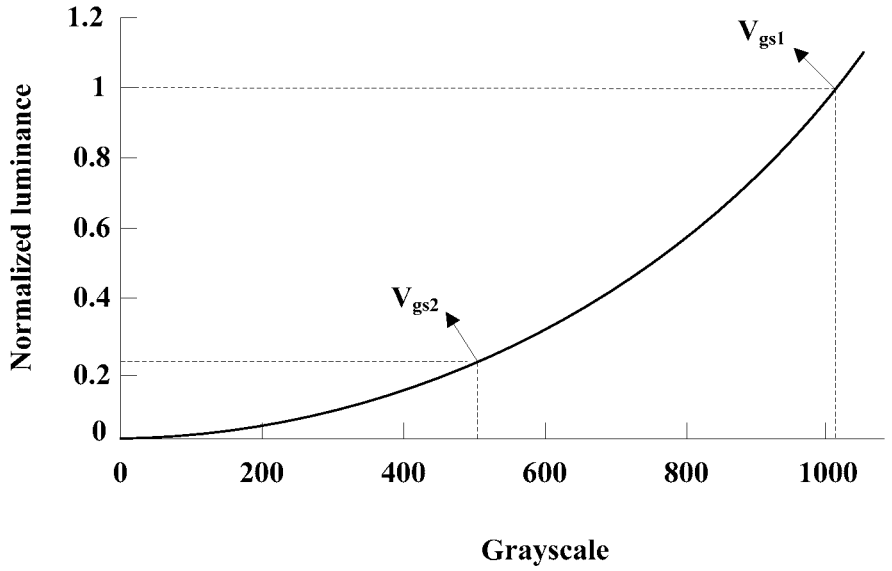
FIG. 4 a graph schematically illustrating a luminance versus a grayscale value according to an embodiment of the present disclosure.

FIG. 4 a graph schematically illustrating a luminance versus a grayscale value according to an embodiment of the present disclosure. For example, the curve may be represented by an expression $$L = \left(\frac{GL}{1023}\right)^{2.2}.$$

It can be understood by those skilled in the art that the curve of the luminance versus the grayscale value shown in FIG. 4 is merely exemplary. The curve of the luminance versus the grayscale value of embodiments of the present disclosure may not be limited thereto.

In other embodiments, the first compensation grayscale value $GL_1$ is input to the circuit of the display panel such that the pixel emits light, and the first compensation luminance $L_1$ is obtained by detecting the luminance of the light. Similarly, the second compensation luminance $L_2$ is also obtained by the same or similar method, which will not be described in detail herein.

In some embodiments, the first compensation grayscale value $GL_1$ is input to the circuit of the display panel, and the gate-source voltage of the driving transistor of the pixel circuit is detected to obtain a corresponding first gate-source voltage $V_{gs1}$. It should be noted that the grayscale value is converted into a data voltage by a grayscale-to-voltage conversion circuit, and the data voltage is input to a gate electrode of the driving transistor of the pixel circuit. In the case that the potential of a source electrode of the driving transistor is 0V, the data voltage is the first gate-source voltage $V_{gs1}$ corresponding to the first compensation grayscale value $GL_1$. Similarly, the second gate-source voltage $V_{gs2}$ of the driving transistor corresponding to the second compensation grayscale value $GL_2$ is also obtained by the same or similar method, which will not be described in detail herein.

In step S106, a theoretical luminance L corresponding to an input grayscale value GL is obtained. The theoretical luminance is a desired luminance after being compensated.

In some embodiments, the step S106 comprises: obtaining a corresponding theoretical luminance L according to the input grayscale value GL and the curve of the luminance versus the grayscale value. For example, the curve of the luminance versus the grayscale value may be shown as FIG.

4. Certainly, it can be understood by those skilled in the art that the curve of the luminance versus the grayscale value shown in FIG. 4 is merely exemplary, and the scope of embodiments of the present disclosure is not limited thereto.

In step S108, a compensation gate-source voltage $V'_{gs}$ is calculated according to the theoretical luminance L, the first compensation luminance $L_1$, the first gate-source voltage $V_{gs1}$, the second compensation luminance $L_2$, and the second gate-source voltage $V_{gs2}$.

In some embodiments, the calculation equation of the compensation gate-source voltage $V'_{gs}$ is:

$$V'_{gs} = \sqrt[a]{\frac{L}{L_1}} * \frac{\sqrt[a]{\frac{L_1}{L_2}}(V_{gs1} - V_{gs2})}{\sqrt[a]{\frac{L_1}{L_2}} - 1} + \frac{V_{gs2} * \sqrt[a]{\frac{L_1}{L_2}} - V_{gs1}}{\sqrt[a]{\frac{L_1}{L_2}} - 1} \quad (1)$$

wherein, parameter "a" is a known exponential parameter. For example, the parameter "a" takes a value of 2. Of course, the value of a may also be other values depending on different design parameters and production processes. For example, the value of a may be obtained by the method shown in FIG. 5. The method of obtaining the value of a shown in FIG. 5 will be described in detail later.

The process of obtaining the calculation equation (1) will be described in detail below.

For the compensation gate-source voltage $V'_{gs}$ to be calculated, given that the driving current of the driving transistor corresponding to the compensation gate-source voltage $V'_{gs}$ is I, it can be represented as:

$$=I=K(V'_{gs}-V_t)^a \quad (2)$$

wherein, K is a parameter for the relationship between the current and the voltage, and $V_t$ is the threshold voltage of the driving transistor.

The driving current I corresponds to the theoretical luminance L obtained above. The driving current of the driving transistor is proportional to the luminance of the pixel, then $$\frac{I}{I_1} = \frac{L}{L_1} \quad (3)$$

From equations (2) and (3), it can be derived that $$V'_{gs} = \sqrt[a]{\frac{L}{L_1}} * \sqrt[a]{\frac{I_1}{K}} + V_t \quad (4)$$

Thus, $V'_{gs}$ may be calculated after $$\sqrt[a]{\frac{I_1}{K}}$$

and $V_t$ are obtained.

In the case that the first gate-source voltage $V_{gs1}$ is applied to the driving transistor, a first driving current $I_1$ output by the driving transistor is $$I_1=K(V_{gs1}-V_t)^a \quad (5)$$

In the case that the second gate-source voltage $V_{gs2}$ is applied to the driving transistor, a second driving current $I_2$ output by the driving transistor is $$I_2=K(V_{gs2}-V_t)^a \quad (6)$$

The driving current of the driving transistor is proportional to the luminance of the pixel, then $$\frac{I_1}{I_2} = \frac{L_1}{L_2} \quad (7)$$

From equations (5), (6) and (7), it can be derived that $$V_t = \frac{V_{gs2} * \sqrt[a]{\frac{L_1}{L_2}} - V_{gs1}}{\sqrt[a]{\frac{L_1}{L_2}} - 1} \quad (8)$$

$$\sqrt[a]{\frac{I_1}{K}} = \frac{\sqrt[a]{\frac{L_1}{L_2}} * (V_{gs1} - V_{gs2})}{\sqrt[a]{\frac{L_1}{L_2}} - 1} \quad (9)$$

the above equation (1) is obtained by substituting the equations (8) and (9) into the above equation (4).

According to equation (1), the compensation gate-source voltage $V'_{gs}$ may be calculated using the theoretical luminance L, the first compensation luminance $L_1$, the first gate-source voltage $V_{gs1}$, the second compensation luminance $L_2$, and the second gate-source voltage $V_{gs2}$.

In step S110, an output compensation grayscale value GL' is obtained according to the compensation gate-source voltage $V'_{gs}$.

In some embodiments, the step S110 may comprise: obtaining a compensation gate voltage $V'_g$ according to the compensation gate-source voltage $V'_{gs}$; and obtaining the output compensation grayscale value GL' according to the compensation gate voltage $V'_g$ and a correspondence relationship between a grayscale value and a gate voltage. Here, the correspondence relationship between the grayscale value and the gate voltage is a known correspondence relationship. The output compensation grayscale value GL' is output and converted into a data voltage, and the data voltage is then input to the pixel circuit, thereby achieving compensation for pixel luminance. Since the compensation process may be implemented during the display process, real-time compensation for pixel luminance may be achieved.

In the method of the above embodiment, two compensation grayscale values $GL_1$ and $GL_2$ of the pixel circuit to be compensated are obtained; corresponding compensation luminances $L_1$ and $L_2$ and corresponding gate-source voltages $V_{gs1}$ and $V_{gs2}$ of the driving transistor are respectively obtained by using these two grayscale values; a theoretical luminance L corresponding to an input grayscale value GL is obtained; a compensation gate-source voltage $V'_{gs}$ is obtained through calculation using L, $L_1$, $V_{gs1}$, $L_2$, and $V_{gs2}$, and an output compensation grayscale value GL' is obtained according to $V'_g$s, so that real-time compensation for pixel luminance is achieved. The method of embodiments of the present disclosure may achieve full grayscale compensation. In addition, the method of embodiments of the present disclosure may achieve compensation for pixel luminance without shutting down a display device, and thus may improve the user experience.

Furthermore, the compensation method of embodiments of the present disclosure substantially does not need to change the circuit structures of the pixel circuit and the driving circuit, and thus is advantageous for mass production.

In some embodiments, the first compensation luminance $L_1$ is a maximum luminance $L_{max}$ (the maximum luminance may be set according to actual needs), and the second compensation luminance $L_2$ is $$\frac{L_{max}}{b^a},$$

where b is a setting parameter. For example, the range of b is b>1. The parameter b may be determined according to actual needs. That is, the first compensation grayscale value $GL_1$ and the second compensation grayscale value $GL_2$ obtained in step S102 are the compensation grayscale value corresponding to the maximum luminance $L_{max}$ and the compensation grayscale value corresponding to $$\frac{1}{b^a}$$

of the maximum luminance $L_{max}$, respectively. In this case, $$\frac{L_1}{L_2} = b^a,$$

substituting it into equation (1), there is $$V'_{gs} = \sqrt[a]{\frac{L}{L_{max}}} * \frac{b(V_{gs1} - V_{gs2})}{b-1} + \frac{b * V_{gs2} - V_{gs1}}{b-1}. \tag{10}$$

In this embodiment, by setting $L_1$ to $L_{max}$ and $L_2$ to $$\frac{L_{max}}{b^a},$$

the calculation equation of the compensation gate-source voltage is simplified, which is advantageous for the fast calculation of the above real-time compensation algorithm.

In some embodiments, the maximum luminance $L_{max}$ may be a normalized luminance value. Let $L_{max}$=1 (e.g., as shown in FIG. 4) and b=2, then equation (10) may be further simplified as:

$$V'_{gs} = \sqrt[a]{L} * 2(V_{gs1} - V_{gs2}) + 2V_{gs2} - V_{gs1}. \tag{11}$$

Therefore, in the case that $L_{max}$ is a normalized luminance value of 1 and b=2, the calculation equation of the compensation gate-source voltage is further simplified, which is advantageous for the fast calculation of the above real-time compensation algorithm.

In addition, in this case, equations (8) and (9) are respectively simplified to:

$$V_t = 2V_{gs2} - V_{gs1} \tag{12}$$

$$\sqrt[a]{\frac{I_1}{K}} = 2(V_{gs1} - V_{gs2}) \tag{13}$$

Figure 2:
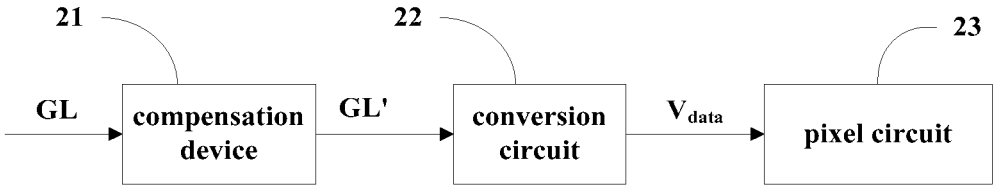
FIG. 2 is a block diagram schematically showing a circuit for a display panel according to an embodiment of the present disclosure.

FIG. 2 is a block diagram schematically showing a circuit for a display panel according to an embodiment of the present disclosure. As shown in FIG. 2, the circuit of the display panel comprises a compensation device 21 for the display panel, a conversion circuit 22, and a pixel circuit 23.

The compensation device 21 is configured to receive an input grayscale value GL, and obtain an output compensation grayscale value GL' by the compensation method of embodiments of the present disclosure (for example, the method as shown in FIG. 1). The compensation device 21 is further configured to transmit the output compensation grayscale value GL' to the conversion circuit 22.

The conversion circuit 22 is configured to convert the output compensation grayscale value GL' into a compensation data voltage $V_{data}$ according to the correspondence relationship between the grayscale value and the voltage after receiving the output compensation grayscale value GL' from the compensation device 21. The conversion circuit 22 is further configured to output the compensation data voltage $V_{data}$ to the pixel circuit 23. For example, the conversion circuit may be a Source IC(Source Integrated Circuit).

The pixel circuit 23 is configured to emit light according to the compensated data voltage $V_{data}$. For example, the pixel circuit 23 emits light with a compensation luminance (i.e., a theoretical luminance L) after receiving the compensation data voltage $V_{data}$.

In the circuit for the display panel of this embodiment, the compensation device performs the steps of the compensation method as described above, and then transmits an obtained output compensation grayscale value to the conversion circuit. The conversion circuit converts the output compensation grayscale value to a compensation data voltage, and transmits the compensation data voltage to the pixel circuit, so that the pixel circuit emits light with the compensation luminance. Thus, the real-time compensation for pixel luminance is achieved.

In some embodiments of the present disclosure, a display panel is provided. The display panel comprises the circuit for the display panel as described above, such as the circuit shown in FIG. 2.

In some embodiments of the present disclosure, a display device is provided. The display device comprises the display panel as described above.

Figure 3:
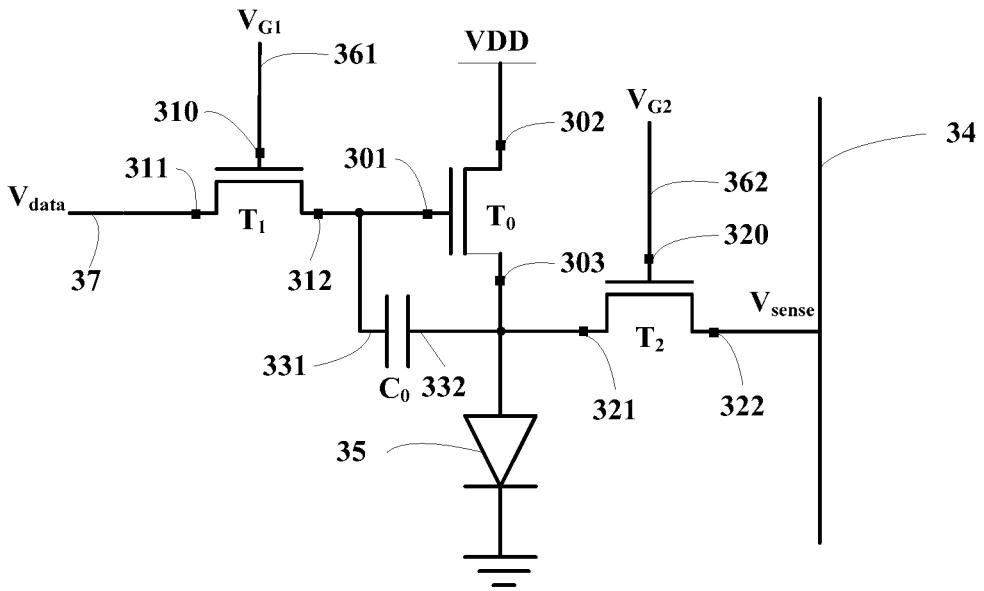
FIG. 3 is a connection diagram schematically showing a pixel circuit according to an embodiment of the present disclosure.

FIG. 3 is a connection diagram schematically showing a pixel circuit according to an embodiment of the present disclosure.

As shown in FIG. 3, in addition to a driving transistor $T_0$, the pixel circuit may further comprises a first switching transistor $T_1$, a second switching transistor $T_2$, a light emitting diode (e.g., OLED) 35, and a capacitor $C_0$.

A gate electrode 310 of the first switching transistor $T_1$ is electrically connected to a first gate line 361. A first electrode 311 of the first switching transistor $T_1$ is electrically connected to a data line 37. A second electrode 312 of the first switching transistor $T_1$ is electrically connected to a gate electrode 301 of the driving transistor $T_0$. The gate electrode 301 of the driving transistor $T_0$ is electrically connected to a first terminal 331 of the capacitor $C_0$. A drain electrode 302 of the driving transistor $T_0$ is electrically connected to a power supply voltage terminal VDD. A source electrode 303 of the driving transistor $T_0$ is electrically connected to an anode terminal of the light emitting diode 35. A second terminal 332 of the capacitor $C_0$ is electrically connected to the anode terminal of the light emitting diode 35. A cathode terminal of the light emitting diode 35 is electrically connected to a ground terminal. A gate electrode 320 of the second switching transistor $T_2$ is electrically connected to a second gate line 362. A first electrode 321 of the second switching transistor $T_2$ is electrically connected to the source electrode 303 of the driving transistor $T_0$. A second electrode 322 of the second switching transistor $T_2$ is electrically connected to a sensing voltage line 34.

In the process of normally writing data, the first switching transistor $T_1$ is turned on, a data voltage $V_{data}$ is written through the data line 37, and the second switching transistor $T_2$ is turned on, a fixed low potential is applied from the sensing voltage line 34. After a certain time (e.g., less than the one line scan time), both the first switching transistor $T_1$ and the second switching transistor $T_2$ are turned off. At this time, the first terminal of the capacitor $C_0$ holds the data voltage $V_{data}$, such that a gate-source voltage $V_{gs}$ is applied to the driving transistor $T_0$, and thus the light emitting diode 35 is illuminated.

In embodiments of the present disclosure, the first compensation grayscale value $GL_1$ and the second compensation grayscale value $GL_2$ of a pixel circuit to be compensated are obtained. The first compensation luminance $L_1$ and the first gate-source voltage $V_{gs1}$ of the driving transistor $T_0$ corresponding to the $GL_1$, and the second compensation luminance $L_2$ and the second gate-source voltage $V_{gs2}$ of the driving transistor $T_0$ corresponding to the $GL_2$ are obtained. The theoretical luminance L corresponding to the input grayscale value GL is obtained. The compensation gate-source voltage $V'_{gs}$ is calculated by L, $L_1$, $V_{gs1}$, $L_2$, and $V_{gs2}$. The output compensation grayscale value GL' is obtained according to the $V'_{gs}$. The obtained output compensation grayscale value GL' is then transmitted to the conversion circuit. The conversion circuit converts the output compensated grayscale value to the compensation data voltage and transmits the compensation data voltage to, for example, the pixel circuit shown in FIG. 3. After receiving the compensation data voltage, the pixel circuit may cause the light emitting diode 35 to emit light with a compensation luminance L. Since the compensation process may be implemented during the display process, real-time compensation for pixel luminance may be achieved.

It should be noted that the pixel circuit shown in FIG. 3 is merely exemplary, and the compensation method of embodiments of the present disclosure may be applied to other pixel circuits in addition to the pixel circuit shown in FIG. 3, and therefore, the scope of embodiments of the present disclosure is not limited thereto.

Figure 5:
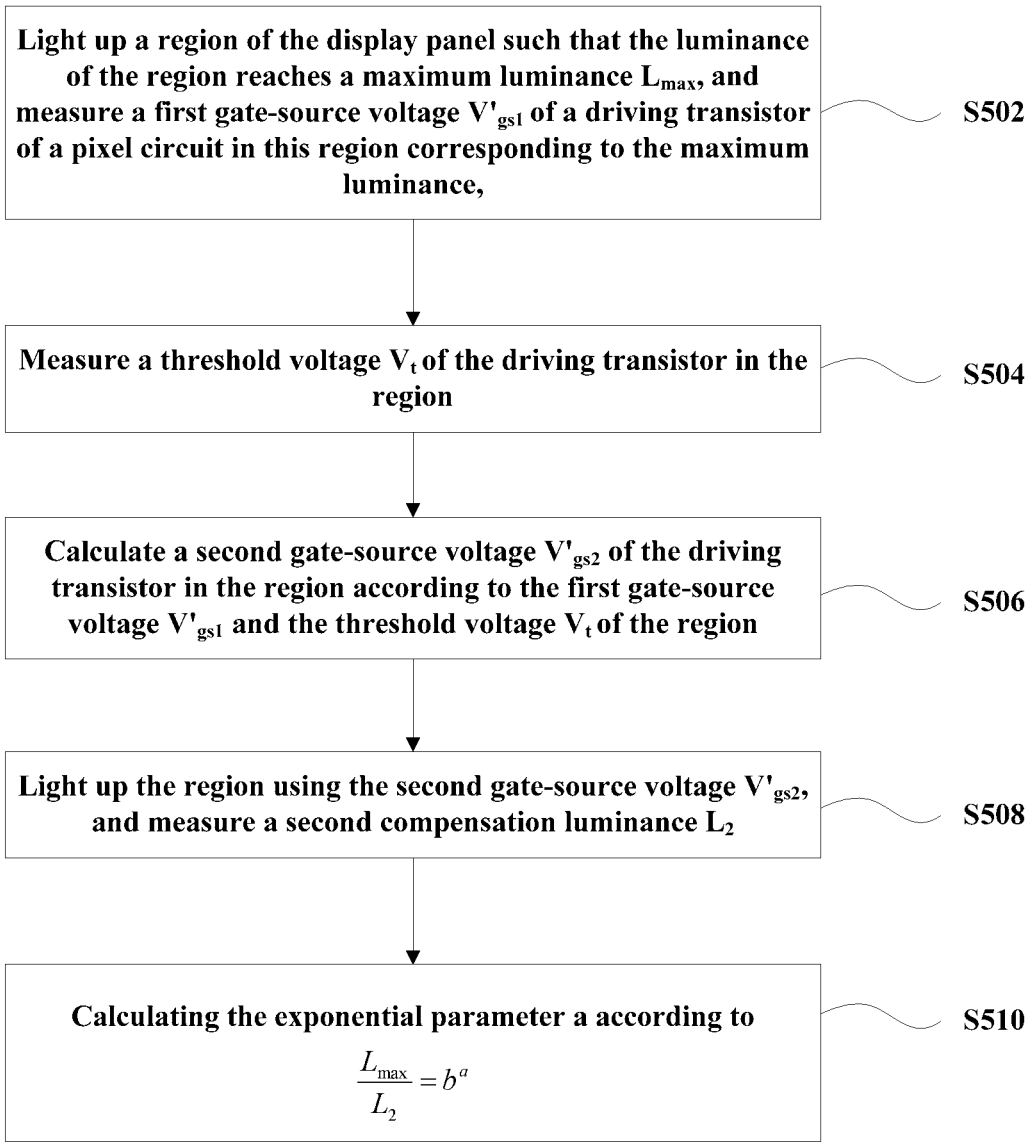
FIG. 5 is a flowchart illustrating a method of obtaining an exponential parameter "a" according to an embodiment of the present disclosure.

FIG. 5 is a flowchart illustrating a method of obtaining an exponential parameter "a" according to an embodiment of the present disclosure.

In step S502, a region of the display panel is lighted up such that the luminance of the region reaches a maximum luminance $L_{max}$. A first gate-source voltage $V'_{gs1}$, which corresponds to the maximum luminance, of a driving transistor of a pixel circuit in the region is measured.

In step S504, a threshold voltage $V_t$ of the driving transistor in the region is measured.

For example, the potential of the source electrode of the driving transistor in the region may be set to 0V, and a data voltage at a moment when the region is just lit is measured. This data voltage is the threshold voltage $V_t$ of the driving transistor.

In step S506, a second gate-source voltage $V'_{gs2}$ of the driving transistor in the region is calculated according to the first gate-source voltage $V'_{gs1}$ and the threshold voltage $V_t$ of the region.

Here, $$V'_{gs2} = \frac{b-1}{b}V_t + \frac{1}{b}V'_{gs1}. \tag{14}$$

This equation (14) is derived from the following equation:

$$\frac{L_1}{L_2} = b^a = \frac{I_1}{I_2} = \frac{K(V'_{gs1} - V_t)^a}{K(V'_{gs2} - V_t)^a} \tag{15}$$

In step S508, the region is lighted up using the second gate-source voltage $V'_{gs2}$, and a second compensation luminance $L_2$ is measured.

In step S510, the exponential parameter "a" is calculated according to $$\frac{L_{max}}{L_2} = b^a.$$

In this embodiment, in the process of the determination of the value of parameter "a", a region is lighted up with the maximum luminance $L_{max}$ and the first gate-source voltage $V'_{gs1}$ is measured. The threshold voltage $V_t$ of the driving transistor in this region is measured. Then, the second gate-source voltage $V'_{gs2}$ is calculated according to $V'_{gs1}$ and Vt. The region is lighted up using $V'_{gs2}$ and a luminance $L_2$ is measured. The exponential parameter "a" is calculated according to $$\frac{L_{max}}{L_2} = b^a.$$

The value of a may be used in the compensation algorithm for all pixel circuits of the display panel. The value of a is calibrated through the above method, so that a better display compensation effect may be achieved.

Figure 6:
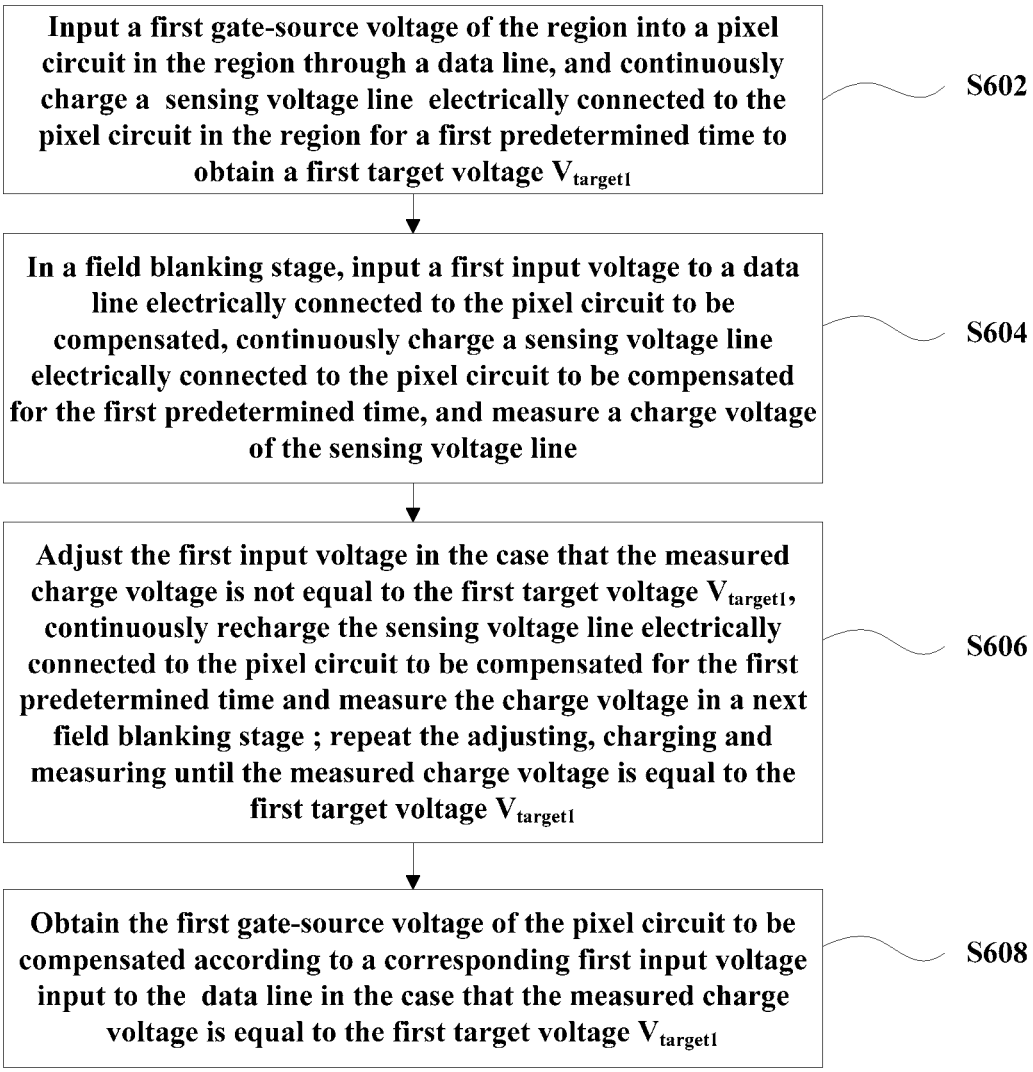
FIG. 6 is a flowchart illustrating a method of obtaining a first gate-source voltage $V_{gs1}$ of a pixel circuit to be compensated according to an embodiment of the present disclosure.

FIG. 6 is a flowchart illustrating a method of obtaining a first gate-source voltage $V_{gs1}$ of a pixel circuit to be compensated according to an embodiment of the present disclosure.

In step S602, a first gate-source voltage of the region is input to a pixel circuit in the region through a data line, and a sensing voltage line electrically connected to the pixel circuit in the region is continuously charged for a first predetermined time to obtain a first target voltage $V_{target1}$. The first target voltage $V_{target1}$ is related to the charging time, a capacitance of the sensing voltage line, etc. Here, the region may be the region that is lighted up in the method of FIG. 5. The first predetermined time may be determined according to the actual situation.

In step S604, in a field blanking stage, a first input voltage is input to a data line electrically connected to a pixel circuit to be compensated, a sensing voltage line electrically connected to the pixel circuit to be compensated is continuously charged for a first predetermined time, and a charge voltage of the sensing voltage line is measured. For example, when the first input voltage is input for the first time, the first gate-source voltage of this region may be used as an initial value of the first input voltage that is input to a pixel circuit to be compensated.

In step S606, the first input voltage is adjusted in the case that the measured charge voltage is not equal to the first target voltage $V_{target1}$, the sensing voltage line electrically connected to the pixel circuit to be compensated is continuously recharged for the first predetermined time and the charge voltage is measured in a next field blanking stage. The adjusting, charging and measuring are repeated until the measured charge voltage is equal to the first target voltage $V_{target1}$.

For example, in a case that the measured charge voltage is greater than the first target voltage $V_{target1}$, the first input voltage is decreased, the sensing voltage line is continuously recharged for the first predetermined time by using the reduced first input voltage and then the charge voltage is measured in the next field blanking stage. For another example, in a case that the measured charge voltage is less than the first target voltage $V_{target1}$, the first input voltage is increased, the sensing voltage line is continuously charged for the first predetermined time by using the increased first input voltage and then the charge voltage is measured in the next field blanking stage. The operation to decrease or increase the first input voltage achieves adjustment of the first input voltage. If the charge voltage measured in the next field blanking stage is still not equal to the first target voltage $V_{target1}$, the first input voltage continues to be decreased or increased. The adjusting, charging, and measuring are repeated until the measured charge voltage is equal to the first target voltage $V_{target1}$.

In step S608, the first gate-source voltage of the pixel circuit to be compensated is obtained according to a corresponding first input voltage input to the data line in the case that the measured charge voltage is equal to the first target voltage $V_{target1}$.

In the above embodiment, the charging current for charging the sensing voltage line and the driving current for driving the light emitting diode to emit light are both related to the gate-source voltage, and the operation of charging the sensing voltage line and the operation of driving the light emitting diode to emit light are both performed with the first gate-source voltage. Therefore, the charging current and the driving current are equal. In the above process, if the measured charge voltage is equal to the first target voltage $V_{target1}$ by charging the sensing voltage line for the first predetermined time using the first input voltage through adjustment, it indicates that the charging current corresponding to the first input voltage is equal to the charging current corresponding to the first target voltage $V_{target1}$. Since the first target voltage $V_{target1}$ corresponds to the compensated first gate-source voltage of this region, the first input voltage at this time also corresponds to the first gate-source voltage $V_{gs1}$ of the pixel circuit to be compensated, and thus the purpose of obtaining the first gate-source voltage $V_{gs1}$ of the pixel circuit to be compensated is achieved. In addition, since the process as mentioned above of obtaining the first gate-source voltage $V_{gs1}$ is performed in the field blanking stage, this process does not affect the normal display of the display panel, and thus the user experience is better.

Figure 7:
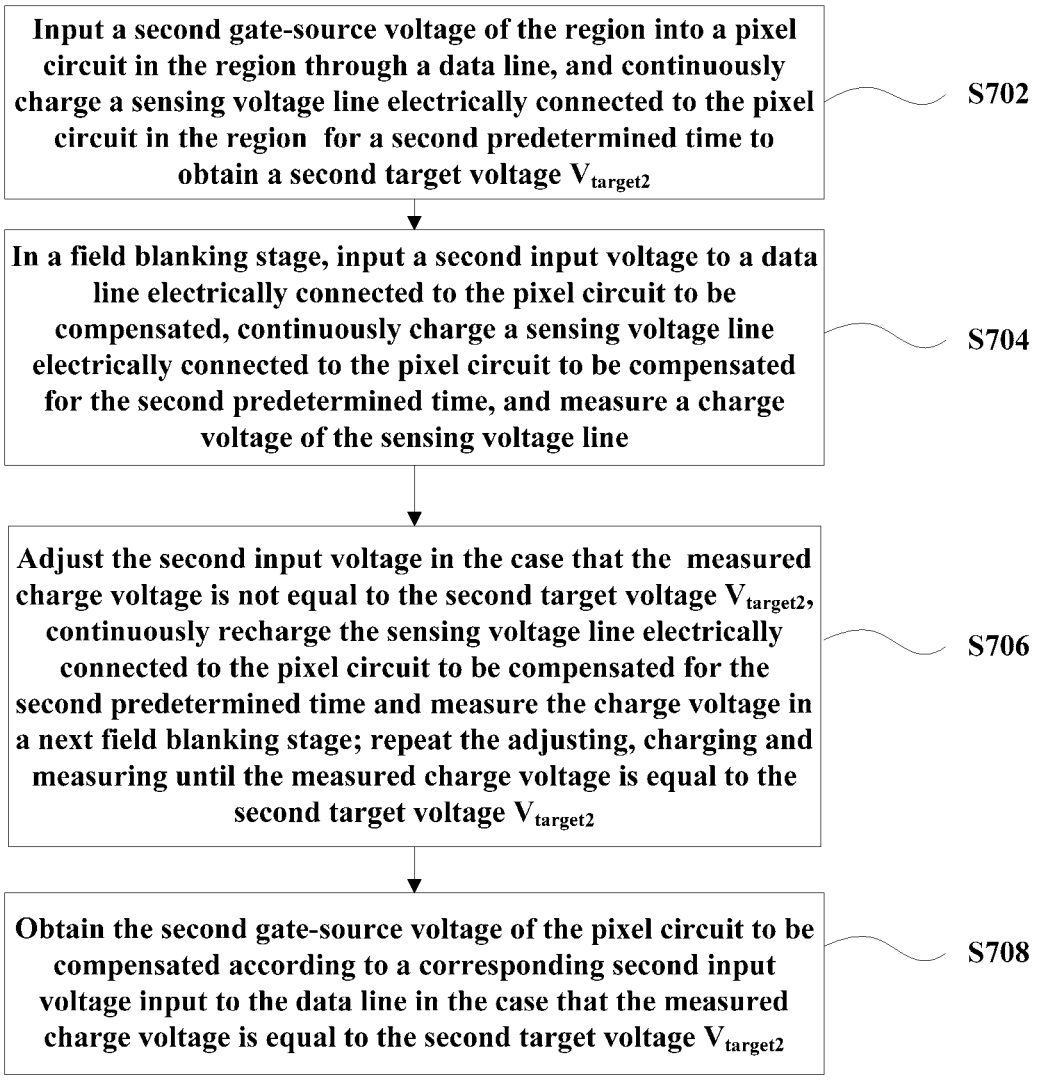
FIG. 7 is a flowchart illustrating a method of obtaining a second gate-source voltage $V_{gs2}$ of a pixel circuit to be compensated according to an embodiment of the present disclosure.

FIG. 7 is a flowchart illustrating a method of obtaining a second gate-source voltage $V_{gs2}$ of a pixel circuit to be compensated according to an embodiment of the present disclosure.

In step S702, a second gate-source voltage of the region is input to a pixel circuit in the region through a data line, and a sensing voltage line electrically connected to the pixel circuit in the region is continuously charged for a second predetermined time to obtain a second target voltage $V_{target2}$. The second target voltage $V_{target2}$ is related to the charging time, a capacitance of the sensing voltage line, etc. Here, the region may be the region that is lighted up in the method of FIG. 5. The second predetermined time may be determined according to the actual situation.

In step S704, in a field blanking stage, a second input voltage is input to a data line electrically connected to a pixel circuit to be compensated, a sensing voltage line electrically connected to the pixel circuit to be compensated is continuously charged for a second predetermined time, and a charge voltage of the sensing voltage line is measured. For example, when the second input voltage is input for the first time, the second gate-source voltage of this region may be used as an initial value of the second input voltage that is input to a pixel circuit to be compensated.

In step S706, the second input voltage is adjusted in the case that the measured charge voltage is not equal to the second target voltage $V_{target2}$, the sensing voltage line electrically connected to the pixel circuit to be compensated is continuously recharged for the second predetermined time and the charge voltage is measured in a next field blanking stage. The adjusting, charging and measuring are repeated until the measured charge voltage is equal to the second target voltage $V_{target2}$.

For example, in a case that the measured charge voltage is greater than the second target voltage $V_{target2}$, the second input voltage is decreased, the sensing voltage line is continuously recharged for the second predetermined time by using the reduced second input voltage and then the charge voltage is measured in the next field blanking stage. For another example, in a case that the measured charge voltage is less than the second target voltage $V_{target2}$, the second input voltage is increased, the sensing voltage line is continuously recharged for the second predetermined time by using the increased second input voltage and then the charge voltage is measured in the next field blanking stage. The operation to decrease or increase the second input voltage achieves adjustment of the second input voltage. If the charge voltage measured in the next field blanking stage is still not equal to the second target voltage $V_{target2}$, the second input voltage continues to be decreased or increased. The adjusting, charging and measuring are repeated until the measured charge voltage is equal to the second target voltage $V_{target2}$.

In step S708, the second gate-source voltage of the pixel circuit to be compensated is obtained according to a corresponding second input voltage input to the data line in the case that the measured charge voltage is equal to the second target voltage $V_{target2}$.

In the above embodiment, the charging current for charging the sensing voltage line and the driving current for driving the light emitting diode to emit light are both related to the gate-source voltage, and the operation of charging the sensing voltage line and the operation of driving the light emitting diode to emit light are both performed with the second gate-source voltage. Therefore, the charging current and the driving current are equal. In the above process, if the measured charge voltage is equal to the second target voltage $V_{target2}$ by charging the sensing voltage line for the second predetermined time using the second input voltage through adjustment, it indicates that the charging current corresponding to the second input voltage is equal to the charging current corresponding to the second target voltage $V_{target2}$. Since the second target voltage $V_{target2}$ corresponds to the compensated second gate-source voltage of this region, the second input voltage at this time also corresponds to the second gate-source voltage $V_{gs2}$ of the pixel circuit to be compensated, and thus the purpose of obtaining the second gate-source voltage $V_{gs2}$ of the pixel circuit to be compensated is achieved. In addition, since the process as mentioned above of obtaining the second gate-source voltage $V_{gs2}$ is performed in the field blanking stage, this process does not affect the normal display of the display panel, and thus the user experience is better.

Figure 8:
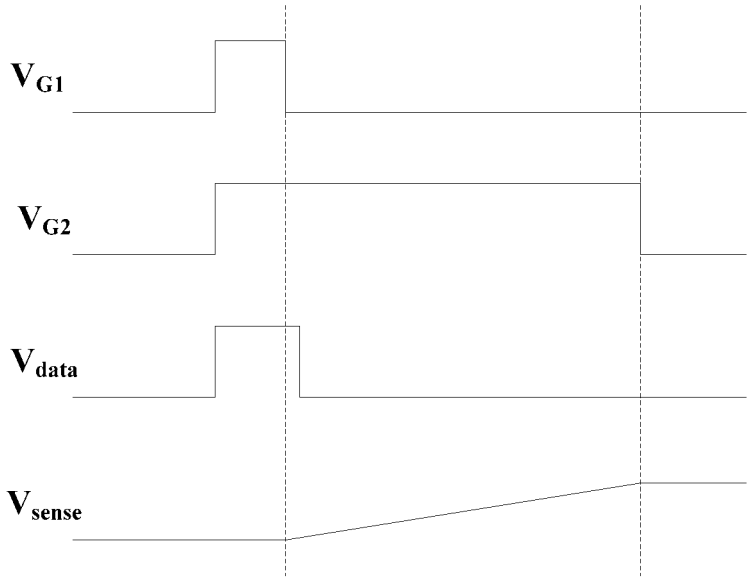
FIG. 8 a timing control diagram schematically showing charging a sensing voltage line according to an embodiment of the present disclosure.

FIG. 8 a timing control diagram schematically showing charging a sensing voltage line according to an embodiment of the present disclosure. The process of charging the sensing voltage line will be described in detail below with reference to FIGS. 3 and 8.

In some embodiments, continuously charging the sensing voltage line for the first predetermined time comprises the following steps:

First, the first switching transistor $T_1$ and the second switching transistor $T_2$ are both turned on, and the first input voltage is input to the data line 37. The first input voltage is stored at the first terminal 331 of the capacitor $C_0$. The driving transistor $T_0$ is turned on by the first input voltage stored at the first terminal.

For example, as shown in FIGS. 3 and 8, a first gate voltage $V_{G1}$ is input to the first gate line 361, and a second gate voltage $V_{G2}$ is input to the second gate line 362. When the first gate voltage $V_{G1}$ and the second gate voltage $V_{G2}$ both change to a high level, the first switching transistor $T_1$ and the second switching transistor $T_2$ are both turned on. The first input voltage is input to the pixel circuit as a data voltage $V_{data}$, such that the first input voltage is stored at the first terminal 331 of the capacitor $C_0$.

Next, the first switching transistor $T_1$ is turned off and the second switching transistor $T_2$ is turned on. The driving transistor $T_0$ is turned on by the first input voltage stored at the first terminal 331 of the capacitor $C_0$. The sensing voltage line 34 is charged for the first predetermined time by the power supply voltage terminal VDD through the driving transistor $T_0$ and the second switching transistor $T_2$.

For example, as shown in FIGS. 3 and 8, the first gate voltage $V_{G1}$ is changed from the high level to a low level, and the second gate voltage $V_{G2}$ is maintained at the high level. After the first gate voltage $V_{G1}$ is changed to the low level, the first switching transistor $T_1$ is turned off, so that the first input voltage is no longer input to the pixel circuit. However, the first input voltage stored at the first terminal 331 of the capacitor $C_0$ enables the driving transistor $T_0$ to be turned on. In such a case, the sensing voltage line 34 is charged for the first predetermined time by the power supply voltage terminal VDD through the driving transistor $T_0$ and the second switching transistor $T_2$, which are turned on. During the charging process, the potential $V_{sense}$ of the sensing voltage line 34 rises, causing that the potential of the first terminal 331 of the capacitor $C_0$ also rises, so that the voltage difference between the gate electrode and the source electrode of the driving transistor does not change. This voltage difference is always equal to the gate-source voltage at the beginning of charging. Since the source potential at the beginning of charging is set to 0V, the gate-source voltage at the beginning of charging is equal to the first input voltage. Thus, after the processing of the method as shown in FIG. 6, in the case that the measured charge voltage is equal to the first target voltage $V_{target1}$, the corresponding first input voltage input to the data line is the first gate-source voltage of the pixel circuit to be compensated.

$T_0$ this end, the process of continuously charging the sensing voltage line for the first predetermined time according to some embodiments of the present disclosure has been described with reference to FIGS. 3 and 8.

In other embodiments, continuously charging the sensing voltage line for the second predetermined time may comprise the following steps:

First, as shown in FIGS. 3 and 8, the first switching transistor $T_1$ and the second switching transistor $T_2$ are both turned on, and the second input voltage is input to the data line 37. The second input voltage is stored at the first terminal 331 of the capacitor $C_0$. The driving transistor $T_0$ is turned on by the second input voltage stored at the first terminal.

For example, similarly to the above description, when the first gate voltage $V_{G1}$ and the second gate voltage $V_{G2}$ both change to a high level, the first switching transistor $T_1$ and the second switching transistor $T_2$ are both turned on. The second input voltage is input to the pixel circuit as a data voltage $V_{data}$, such that the second input voltage is stored at the first terminal 331 of the capacitor $C_0$.

Next, as shown in FIGS. 3 and 8, the first switching transistor $T_1$ is turned off and the second switching transistor $T_2$ is turned on. The driving transistor $T_0$ is turned on by the second input voltage stored at the first terminal 331 of the capacitor $C_0$. The sensing voltage line 34 is charged for the second predetermined time by the power supply voltage terminal VDD through the driving transistor $T_0$ and the second switching transistor $T_2$.

For example, similarly to the above description, the first gate voltage $V_{G1}$ is changed from the high level to a low level, and the second gate voltage $VG_2$ is still maintained at the high level. After the first gate voltage $V_{G1}$ is changed to the low level, the first switching transistor $T_1$ is turned off, so that the second input voltage is no longer input to the pixel circuit. However, the second input voltage stored at the first terminal 331 of the capacitor $C_0$ enables the driving transistor $T_0$ to be turned on. In such a case, the sensing voltage line 34 is charged for the second predetermined time by the power supply voltage terminal VDD through the driving transistor $T_0$ and the second switching transistor $T_2$, which are turned on. During the charging process, the potential $V_{sense}$ of the sensing voltage line 34 rises. Similarly to the previous analysis, by such a charging process, after the processing of the method as shown in FIG. 7, in the case that the measured charge voltage is equal to the second target voltage $V_{target2}$, the corresponding second input voltage input to the data line is the second gate-source voltage of the pixel circuit to be compensated.

$T_0$ this end, the process of continuously charging the sensing voltage line for the second predetermined time according to some embodiments of the present disclosure has been described with reference to FIGS. 3 and 8.

Figure 9:
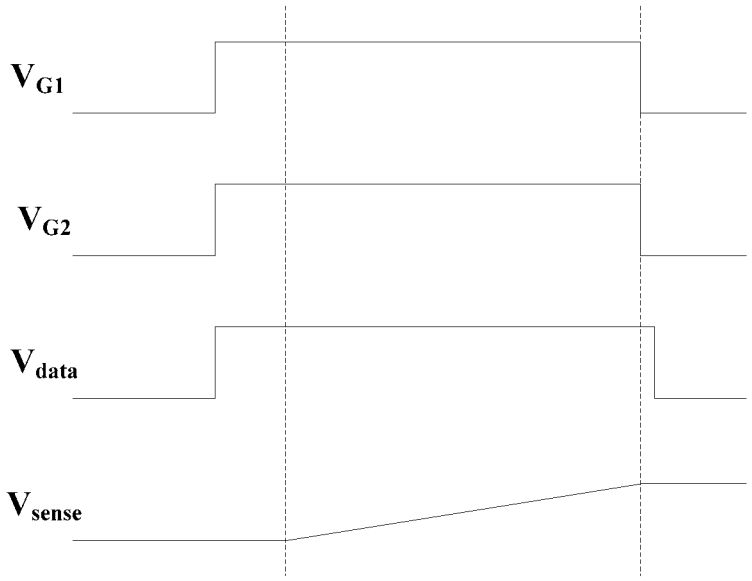
FIG. 9 a timing control diagram schematically showing charging a sensing voltage line according to another embodiment of the present disclosure.

FIG. 9 a timing control diagram schematically showing charging a sensing voltage line according to another embodiment of the present disclosure. The process of charging the sensing voltage line will be described in detail below with reference to FIGS. 3 and 9.

In some embodiments, the step of continuously charging the sensing voltage line for the first predetermined time may comprise the following steps: as shown in FIGS. 3 and 9, turning on the first switching transistor $T_1$ and the second switching transistor $T_2$, and inputting the first input voltage (as a data voltage $V_{data}$) to the data line 37 to turn on the driving transistor $T_0$, so that the sensing voltage line 34 is charged for the first predetermined time by the power supply voltage terminal VDD through the driving transistor $T_0$ and the second switching transistor $T_2$.

For example, as shown in FIGS. 3 and 9, a first gate voltage $V_{G1}$ is input to the first gate line 361, and a second gate voltage $V_{G2}$ is input to the second gate line 362. During the charging process, the first gate voltage $V_{G1}$ and the second gate voltage $VG_2$ are maintained at a high level, i.e., the first switching transistor $T_1$ and the second switching transistor $T_2$ are both turned on. During the charging process, the potential $V_{sense}$ of the sensing voltage line 34 rises. However, since the first switching transistor $T_1$ is always turned on, the first input voltage is continuously input to the gate electrode 301 of the driving transistor $T_0$. Thus, after the processing of the method as shown in FIG. 6, in the case that the measured charge voltage is equal to the first target voltage $V_{target1}$, a difference between the corresponding first input voltage input to the data line and the measured charge voltage is the first gate-source voltage of the pixel circuit to be compensated.

In other embodiments, the step of continuously charging the sensing voltage line for the second predetermined time may comprise the following steps: as shown in FIGS. 3 and 9, turning on the first switching transistor $T_1$ and the second switching transistor $T_2$, and inputting the second input voltage (as a data voltage $V_{data}$) to the data line 37 to turn on the driving transistor $T_0$, so that the sensing voltage line 34 is charged for the second predetermined time by the power supply voltage terminal VDD through the driving transistor $T_0$ and the second switching transistor $T_2$.

Similarly to the above description, during the charging process, the potential $V_{sense}$ of the sensing voltage line 34 rises. However, since the first switching transistor $T_1$ is always turned on, the second input voltage is continuously input to the gate electrode 301 of the driving transistor $T_0$. Thus, after the processing of the method as shown in FIG. 7, in the case that the measured charge voltage is equal to the second target voltage $V_{target2}$, a difference between the corresponding second input voltage input to the data line and the measured charge voltage is the second gate-source voltage of the pixel circuit to be compensated.

Figure 10:
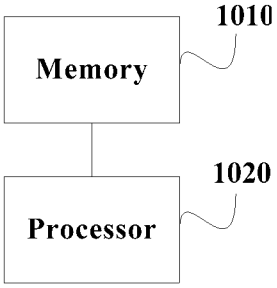
FIG. 10 is a structural diagram schematically illustrating a compensation device for a display panel according to an embodiment of the present disclosure.

FIG. 10 is a structural diagram schematically illustrating a compensation device for a display panel according to an embodiment of the present disclosure. The compensation device comprises a memory 1010 and a processor 1020.

The memory 1010 may be a magnetic disk, flash memory or any other non-volatile storage medium. The memory is used to store instructions of the embodiment corresponding to at least one of FIGS. 1, 5, 6, and 7.

The processor 1020 is coupled to the memory 1010 and may be implemented as one or more integrated circuits, such as a microprocessor or microcontroller. The processor 1020 is used to execute the instructions stored in the memory to achieve real-time full grayscale compensation of the pixel circuit to be compensated.

Figure 11:
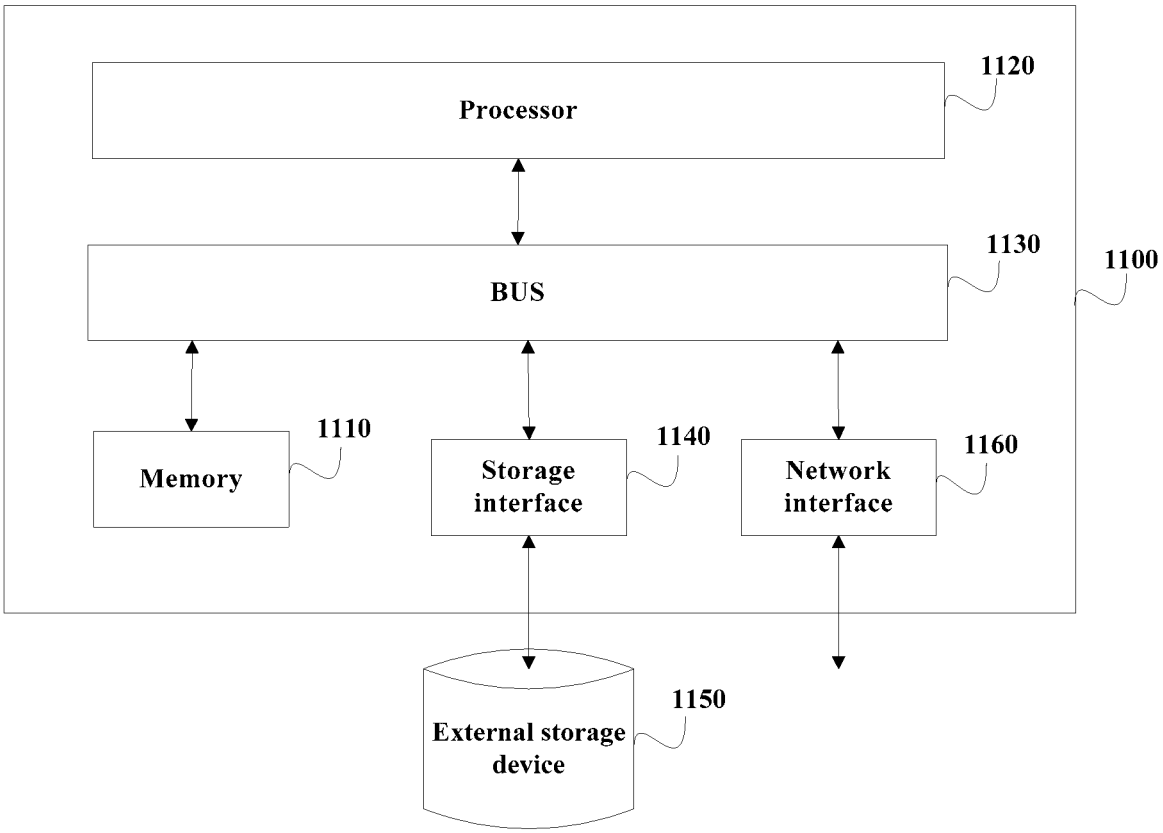
FIG. 11 is a structural diagram schematically illustrating a compensation device for a display panel according to another embodiment of the present disclosure.

In some embodiments, as illustrated in FIG. 11, the compensation device 1100 comprises a memory 1110 and a processor 1120. The processor 1120 is coupled to the memory 1110 via a bus 1130. The compensation device 1100 may be further connected to an external storage device 1150 through a storage interface 1140 to access external data, and may be further connected to a network or another computer system (not shown) through a network interface 1160.

In this embodiment, through storing data instructions in the memory and processing the above instructions using the processor, real-time full grayscale compensation of the pixel circuit to be compensated may be achieved.

In other embodiments, the present disclosure further provides a computer-readable storage medium having computer program instructions stored thereon that. When the instructions executed by a processor, the method steps of the embodiment corresponding to at least one of FIGS. 1, 5, 6, and 7 are implemented. One skilled in the art should understand that, the embodiments of the present disclosure may be provided as a method, an apparatus, or a computer program product. Therefore, embodiments of the present disclosure can take the form of an entirely hardware embodiment, an entirely software embodiment or an embodiment containing both hardware and software elements. Moreover, the present disclosure may take the form of a computer program product embodied on one or more computer-usable non-transitory storage media (comprising but not limited to disk storage, CD-ROM, optical memory, etc.) having computer-usable program code embodied therein.

The present disclosure is described with reference to flowcharts and/or block diagrams of methods, apparatuses (systems) and computer program products according to embodiments of the present disclosure. It should be understood that each process and/or block in the flowcharts and/or block diagrams, and combinations of the processes and/or blocks in the flowcharts and/or block diagrams may be implemented by computer program instructions. The computer program instructions may be provided to a processor of a general purpose computer, a special purpose computer, an embedded processor, or other programmable data processing device to generate a machine such that the instructions executed by a processor of a computer or other programmable data processing device generate means implementing the functions specified in one or more flows of the flowcharts and/or one or more blocks of the block diagrams.

The computer program instructions may also be stored in a computer readable memory device capable of directing a computer or other programmable data processing device to operate in a specific manner such that the instructions stored in the computer readable memory device produce an article of manufacture comprising instruction means implementing the functions specified in one or more flows of the flowcharts and/or one or more blocks of the block diagrams.

These computer program instructions can also be loaded onto a computer or other programmable device to perform a series of operation steps on the computer or other programmable device to generate a computer-implemented process such that the instructions executed on the computer or other programmable device provide steps implementing the functions specified in one or more flows of the flowcharts and/or one or more blocks of the block diagrams.

Heretofore, various embodiments of the present disclosure have been described in detail. In order to avoid obscuring the concepts of the present disclosure, some details known in the art are not described. Based on the above description, those skilled in the art can understand how to implement the technical solutions disclosed herein.

Although some specific embodiments of the present disclosure have been described in detail by way of example, those skilled in the art should understand that the above examples are only for the purpose of illustration and are not intended to limit the scope of the present disclosure. It should be understood by those skilled in the art that the above embodiments may be modified or equivalently substituted for part of the technical features without departing from the scope and spirit of the present disclosure. The scope of the disclosure is defined by the following claims.

What is claimed is:

1. A compensation method for a display panel, the display panel comprising a plurality of pixel circuits, each of the pixel circuits comprising a driving transistor, the compensation method comprising:

obtaining a first compensation grayscale value $GL_1$ and a second compensation grayscale value $GL_2$ of a pixel circuit to be compensated;

obtaining a first compensation luminance $L_1$, a first gate-source voltage $V_{gs1}$ of the driving transistor, a second compensation luminance $L_2$, and a second gate-source voltage $V_{gs2}$ of the driving transistor, which are of the pixel circuit to be compensated, wherein the first compensation luminance $L_1$ and the first gate-source voltage $V_{gs1}$ correspond to the first compensation grayscale value $GL_1$, and the second compensation luminance $L_2$ and the second gate-source voltage $V_{gs2}$ correspond to the second compensation grayscale value $GL_2$;

obtaining a theoretical luminance L corresponding to an input grayscale value GL;

calculating a compensation gate-source voltage $V'_{gs}$ according to the theoretical luminance L, the first compensation luminance $L_1$, the first gate-source voltage $V_{gs1}$, the second compensation luminance $L_2$, and the second gate-source voltage $V_{gs2}$; and obtaining an output compensation grayscale value GL' according to the compensation gate-source voltage $V'_{gs}$.

2. The compensation method according to claim 1, wherein $$V'_{gs} = \sqrt[a]{\frac{L_1}{L_2}} * \frac{\sqrt[a]{\frac{L_1}{L_2}}(V_{gs1} - V_{gs2})}{\sqrt[a]{\frac{L_1}{L_2}} - 1} + \frac{V_{gs2} * \sqrt[a]{\frac{L_1}{L_2}} - V_{gs1}}{\sqrt[a]{\frac{L_1}{L_2}} - 1}$$

wherein, "a" is a known exponential parameter.

3. The compensation method according to claim 2, wherein the first compensation luminance $L_1$ is a maximum luminance $L_{max}$, the second compensation luminance $L_2$ is $$\frac{L_{max}}{b^a},$$

wherein b is a setting parameter, $$V'_{gs} = \sqrt[a]{\frac{L}{L_{max}}} * \frac{b(V_{gs1} - V_{gs2})}{b-1} + \frac{b * V_{gs2} - V_{gs1}}{b-1}.$$

4. The compensation method according to claim 3, wherein the maximum luminance $L_{max}$ is a normalized luminance value, $$L_{max} = 1 \text{ and } b = 2,\ V'_{gs} = \sqrt[a]{L} * 2(V_{gs1} - V_{gs2}) + 2V_{gs2} - V_{gs1}.$$

5. The compensation method according to claim 3, wherein the exponential parameter "a" is obtained by the following steps:

lighting up a region of the display panel such that a luminance of the region reaches the maximum luminance $L_{max}$, and measuring a first gate-source voltage $V'_{gs1}$ of a driving transistor of a pixel circuit in the region corresponding to the maximum luminance $L_{max}$;

measuring a threshold voltage $V_t$ of the driving transistor in the region;

calculating a second gate-source voltage $V'_{gs2}$ of the driving transistor in the region according to the first gate-source voltage $V'_{gs1}$ and the threshold voltage $V_t$ of the region, wherein $$V'_{gs2} = \frac{b-1}{b}V_t + \frac{1}{b}V'_{gs1};$$

lighting up the region using the second gate-source voltage $V'_{gs2}$, and measuring a second compensation luminance $L_2$; and calculating the exponential parameter "a" according to $$\frac{L_{max}}{L_2} = b^a.$$

6. The compensation method according to claim 5, wherein the pixel circuit further comprises a first switching transistor, a second switching transistor, a light emitting diode, and a capacitor;

a gate electrode of the first switching transistor is electrically connected to a first gate line, a first electrode of the first switching transistor is electrically connected to a data line, a second electrode of the first switching transistor is electrically connected to a gate electrode of the driving transistor;

the gate electrode of the driving transistor is electrically connected to a first terminal of the capacitor, a drain electrode of the driving transistor is electrically connected to a power supply voltage terminal, a source electrode of the driving transistor is electrically connected to an anode terminal of the light emitting diode;

a second terminal of the capacitor is electrically connected to the anode terminal of the light emitting diode, and a cathode terminal of the light emitting diode is electrically connected to a ground terminal;

a gate electrode of the second switching transistor is electrically connected to a second gate line, and a first electrode of the second switching transistor is electrically connected to the source electrode of the driving transistor, and a second electrode of the second switching transistor is electrically connected to a sensing voltage line.

7. The compensation method according to claim 6, wherein the step of obtaining the first gate-source voltage $V_{gs1}$ of the driving transistor of the pixel circuit to be compensated comprises the following steps:

inputting a first gate-source voltage of the region into a pixel circuit in the region through a data line, and continuously charging a sensing voltage line electrically connected to the pixel circuit in the region for a first predetermined time to obtain a first target voltage $V_{target1}$;

in a field blanking stage, inputting a first input voltage to a data line electrically connected to the pixel circuit to be compensated, continuously charging a sensing voltage line electrically connected to the pixel circuit to be compensated for the first predetermined time, and measuring a charge voltage of the sensing voltage line;

adjusting the first input voltage based on a determination that the measured charge voltage is not equal to the first target voltage $V_{target1}$, continuously recharging the sensing voltage line electrically connected to the pixel circuit to be compensated for the first predetermined time and measuring the charge voltage in a next field blanking stage; repeating the adjusting, charging and measuring until the measured charge voltage is equal to the first target voltage $V_{target1}$; and obtaining the first gate-source voltage of the pixel circuit to be compensated according to a corresponding first input voltage input to the data line based on a determination that the measured charge voltage is equal to the first target voltage $V_{target1}$.

8. The compensation method according to claim 6, wherein the step of obtaining the second gate-source voltage $V_{gs2}$ of the driving transistor of the pixel circuit to be compensated comprises the following steps:

inputting a second gate-source voltage of the region into a pixel circuit in the region through a data line, and continuously charging a sensing voltage line electrically connected to the pixel circuit in the region for a second predetermined time to obtain a second target voltage $V_{target2}$;

in a field blanking stage, inputting a second input voltage to a data line electrically connected to the pixel circuit to be compensated, continuously charging a sensing voltage line electrically connected to the pixel circuit to be compensated for the second predetermined time, and measuring a charge voltage of the sensing voltage line;

adjusting the second input voltage based on a determination that the measured charge voltage is not equal to the second target voltage $V_{target2}$, continuously recharging the sensing voltage line electrically connected to the pixel circuit to be compensated for the second predetermined time and measuring the charge voltage in a next field blanking stage; repeating the adjusting, charging and measuring until the measured charge voltage is equal to the second target voltage $V_{target2}$; and obtaining the second gate-source voltage of the pixel circuit to be compensated according to a corresponding second input voltage input to the data line based on a determination that the measured charge voltage is equal to the second target voltage $V_{target2}$.

9. The compensation method according to claim 7, wherein, the step of continuously charging the sensing voltage line for the first predetermined time comprises the following steps:

turning on the first switching transistor and the second switching transistor, and inputting the first input voltage to the data line, with the first input voltage being stored at the first terminal of the capacitor and the driving transistor being turned on by the first input voltage stored at the first terminal; and turning off the first switching transistor and turning on the second switching transistor, so that the sensing voltage line is charged for the first predetermined time by the power supply voltage terminal through the driving transistor and the second switching transistor;

wherein, based on a determination that the measured charge voltage is equal to the first target voltage $V_{target1}$, the corresponding first input voltage input to the data line is the first gate-source voltage of the pixel circuit to be compensated.

10. The compensation method according to claim 7, wherein, the step of continuously charging the sensing voltage line for the first predetermined time comprises the following steps:

turning on the first switching transistor and the second switching transistor, and inputting the first input voltage to the data line to turn on the driving transistor, so that the sensing voltage line is charged for the first predetermined time by the power supply voltage terminal through the driving transistor and the second switching transistor;

wherein, based on a determination that the measured charge voltage is equal to the first target voltage $V_{target1}$, a difference between the corresponding first input voltage input to the data line and the measured charge voltage is the first gate-source voltage of the pixel circuit to be compensated.

11. The compensation method according to claim 8, wherein, the step of continuously charging the sensing voltage line for the second predetermined time comprises the following steps:

turning on the first switching transistor and the second switching transistor, and inputting the second input voltage to the data line, with the second input voltage being stored at the first terminal of the capacitor and the driving transistor being turned on by the second input voltage stored at the first terminal; and turning off the first switching transistor and turning on the second switching transistor, so that the sensing voltage line is charged for the second predetermined time by the power supply voltage terminal through the driving transistor and the second switching transistor;

wherein, based on a determination that the measured charge voltage is equal to the second target voltage $V_{target2}$, the corresponding second input voltage input to the data line is the second gate-source voltage of the pixel circuit to be compensated.

12. The compensation method according to claim 8, wherein, the step of continuously charging the sensing voltage line for the second predetermined time comprises the following steps:

turning on the first switching transistor and the second switching transistor, and inputting the second input voltage to the data line to turn on the driving transistor, so that the sensing voltage line is charged for the second predetermined time by the power supply voltage terminal through the driving transistor and the second switching transistor;

wherein, based on a determination that the measured charge voltage is equal to the second target voltage $V_{target2}$, a difference between the corresponding second input voltage input to the data line and the measured charge voltage is the second gate-source voltage of the pixel circuit to be compensated.

13. The compensation method according to claim 1, wherein the step of obtaining the theoretical luminance L corresponding to the input grayscale value GL comprises:

obtaining a corresponding theoretical luminance L according to the input grayscale value GL and a curve of a luminance versus a grayscale value.

14. The compensation method according to claim 1, wherein the step of obtaining the output compensation grayscale value GL' according to the compensation gate-source voltage $V'_{gs}$ comprises the following steps:

obtaining a compensation gate voltage $V'_g$ according to the compensation gate-source voltage $V'_{gs}$; and obtaining the output compensation grayscale value GL' according to the compensation gate voltage $V'_g$ and a correspondence relationship between a grayscale value and a gate voltage.

15. A compensation device for a display panel, comprising:

a memory; and a processor coupled to the memory, the processor configured to execute the method according to claim 1 based on instructions stored in the memory.

16. A circuit for a display panel, comprising:

a compensation device configured to receive an input grayscale value GL, and obtain an output compensation grayscale value GL' according to the compensation method of claim 1;

a conversion circuit configured to convert the output compensation grayscale value GL' to a compensation data voltage $V_{data}$ according to a correspondence relationship between a grayscale value and a voltage after receiving the output compensation grayscale value GL' from the compensation device; and a pixel circuit configured to emit light according to the compensation data voltage $V_{data}$.

17. A display panel, comprising: the circuit for the display panel according to claim 16.

18. A display device, comprising: the display panel according to claim 17.

19. A non-transitory computer-readable storage medium on which computer program instructions are stored, wherein the computer program instructions when executed by a processor implement the steps of the method according to claim 1.

* * * * *